US008978203B2

(12) United States Patent
Krajenke et al.

(10) Patent No.: US 8,978,203 B2
(45) Date of Patent: Mar. 17, 2015

(54) DECKLID HINGE ASSEMBLY FOR A VEHICLE

(71) Applicant: GM Global Technology Operations LLC, Detroit, MI (US)

(72) Inventors: Gary W. Krajenke, Warren, MI (US); Graham S. Foulkes, Washington Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 18 days.

(21) Appl. No.: 13/853,105

(22) Filed: Mar. 29, 2013

(65) Prior Publication Data

US 2014/0290007 A1 Oct. 2, 2014

(51) Int. Cl.
*E05F 5/00* (2006.01)
*E05F 5/06* (2006.01)
*E05D 7/083* (2006.01)

(52) U.S. Cl.
CPC .. *E05F 5/06* (2013.01); *E05D 7/083* (2013.01)
USPC ..... 16/86 R; 16/375; 296/76

(58) Field of Classification Search
CPC ..... E05Y 2900/548; B62D 25/12; E05F 5/04; E05F 5/06
USPC ..... 16/374, 375, 82, 83, 85–86 C, 306, 289; 296/56, 76, 146.11, 146.8; 49/381
See application file for complete search history.

(56) References Cited

U.S. PATENT DOCUMENTS

| | | | | |
|---|---|---|---|---|
| 3,643,755 | A * | 2/1972 | Gionet et al. | 180/69.21 |
| 5,873,619 | A * | 2/1999 | Lewkoski et al. | 296/76 |
| 7,731,262 | B2 * | 6/2010 | Shoemaker et al. | 296/76 |
| 7,815,241 | B2 * | 10/2010 | Renke et al. | 296/146.11 |
| 8,677,563 | B2 * | 3/2014 | Diep et al. | 16/82 |
| 2012/0324795 | A1 * | 12/2012 | Krajenke et al. | 49/381 |
| 2013/0119698 | A1 * | 5/2013 | Patzer et al. | 296/146.12 |

* cited by examiner

*Primary Examiner* — William Miller
(74) *Attorney, Agent, or Firm* — Quinn Law Group, PLLC

(57) ABSTRACT

A hinge assembly includes a hinge box, and a decklid attachment bracket rotatably attached to the hinge box. The decklid attachment bracket includes a contoured surface. A compressible member is positioned for engagement with the contoured surface as the decklid attachment bracket moves between an open position and a closed position. The contoured surface defines an outer region, a recessed region, and an inner region. The outer region compresses the compressible member as the decklid attachment bracket moves between the open and closed positions to absorb energy and dampen movement of the decklid attachment bracket. The recessed region cradles the compressible member without substantially compressing the compressible member when the decklid attachment bracket is in the open position to secure the position of the decklid attachment bracket. The inner region compresses the compressible member to absorb energy, and limit movement of the decklid attachment bracket beyond the open position.

18 Claims, 5 Drawing Sheets

DECKLID HINGE ASSEMBLY FOR A VEHICLE

TECHNICAL FIELD

The invention generally relates to a hinge assembly for rotatably supporting a decklid of a vehicle.

BACKGROUND

Vehicles include a decklid for closing a cargo area of the vehicle, e.g., a trunk. A hinge assembly rotatably attaches the decklid to the vehicle. Upon un-latching the decklid, the decklid is free to rotate from a closed position upward into an open position. Many hinge assemblies are counter-balanced, or include other opening mechanisms, to automatically raise the decklid once un-latched, thereby automatically raising the decklid into the open position. When automatically opening, the decklid and components of the hinge assembly move with a velocity, thereby generating momentum, i.e., energy, in the decklid and components of the hinge assembly. If the decklid and the attached components of the hinge assembly come to an abrupt stop upon reaching the open position, the decklid will often bounce back downward. This bounce back is often referred to as a "bobble" effect, and may be undesirable to users.

SUMMARY

A hinge assembly for a trunk decklid of a vehicle is provided. The hinge assembly includes a hinge box, and a decklid attachment bracket. The decklid attachment bracket includes a contoured surface, and is rotatably attached to the hinge box for rotation about a rotation axis between an open position and a closed position. A compressible member is positioned relative to the decklid attachment bracket for engagement with the contoured surface as the decklid attachment bracket moves between the open position and the closed position. The contoured surface defines an outer region, a recessed region, and an inner region. The outer region compresses the compressible member as the decklid attachment bracket moves into and out of the open position, to absorb energy and dampen movement of the decklid attachment bracket relative to the hinge box. The recessed region cradles the compressible member without substantially compressing the compressible member when the decklid attachment bracket is disposed in the open position. The inner region compresses the compressible member to absorb energy and dampen movement of the decklid attachment bracket relative to the hinge box, to limit movement of the decklid attachment bracket beyond the open position.

A vehicle is also provided. The vehicle includes a body defining an opening, and a hinge assembly rotatably interconnecting a decklid to the body for rotation about a rotation axis. The decklid is rotatable between an open position and a closed position. The hinge assembly includes a hinge box, and a decklid attachment bracket. The decklid attachment bracket is rotatably attached to the hinge box for rotation about the rotation axis between the open position and the closed position. The decklid attachment bracket includes a deflection member that is moveable with the decklid attachment bracket, and defines a contoured surface. A compressible member is attached to one of the body or the hinge box. The compressible member is positioned relative to the deflection member for engagement with the contoured surface as the deflection member moves between the open position and the closed position. The contoured surface defines an outer region, a recessed region, and an inner region. The outer region compresses the compressible member as the decklid attachment bracket moves into and out of the open position, to absorb energy and dampen movement of the decklid attachment bracket relative to the hinge box. The recessed region cradles the compressible member without substantially compressing the compressible member when the decklid attachment bracket is disposed in the open position. The inner region compresses the compressible member to absorb energy and dampen movement of the decklid attachment bracket relative to the hinge box, to limit movement of the decklid attachment bracket beyond the open position. The deflection member deflects away from the compressible member when the compressible member is engaged with either of the outer region or the inner region of the contoured surface to absorb energy and dampen movement of the decklid attachment bracket relative to the hinge box.

Accordingly, the interaction between the compressible member and the contoured surface, as well as the interaction between the compressible member and the deflection member, absorbs energy of the moving decklid and/or decklid attachment bracket to bring the decklid and/or decklid attachment bracket to a stop when moving from the closed position into the open position, i.e., an opening operation, thereby preventing any bobble, i.e., bounce back, of the decklid and/or decklid attachment bracket. The hinge assembly absorbs the energy by compressing the compressible member and deflecting or flexing the deflection member. Additionally, the recessed region of the contoured surface resists movement of the decklid and/or the bracket from moving from the open position into the closed position, i.e., a closing operation, thereby increasing a holding force applied to the decklid to keep the decklid in the open position.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims. Furthermore, the invention may be described herein in terms of functional and/or logical block components and/or various processing steps. It should be realized that such block components may be realized by any number of hardware, software, and/or firmware components configured to perform the specified functions.

Figure 1:
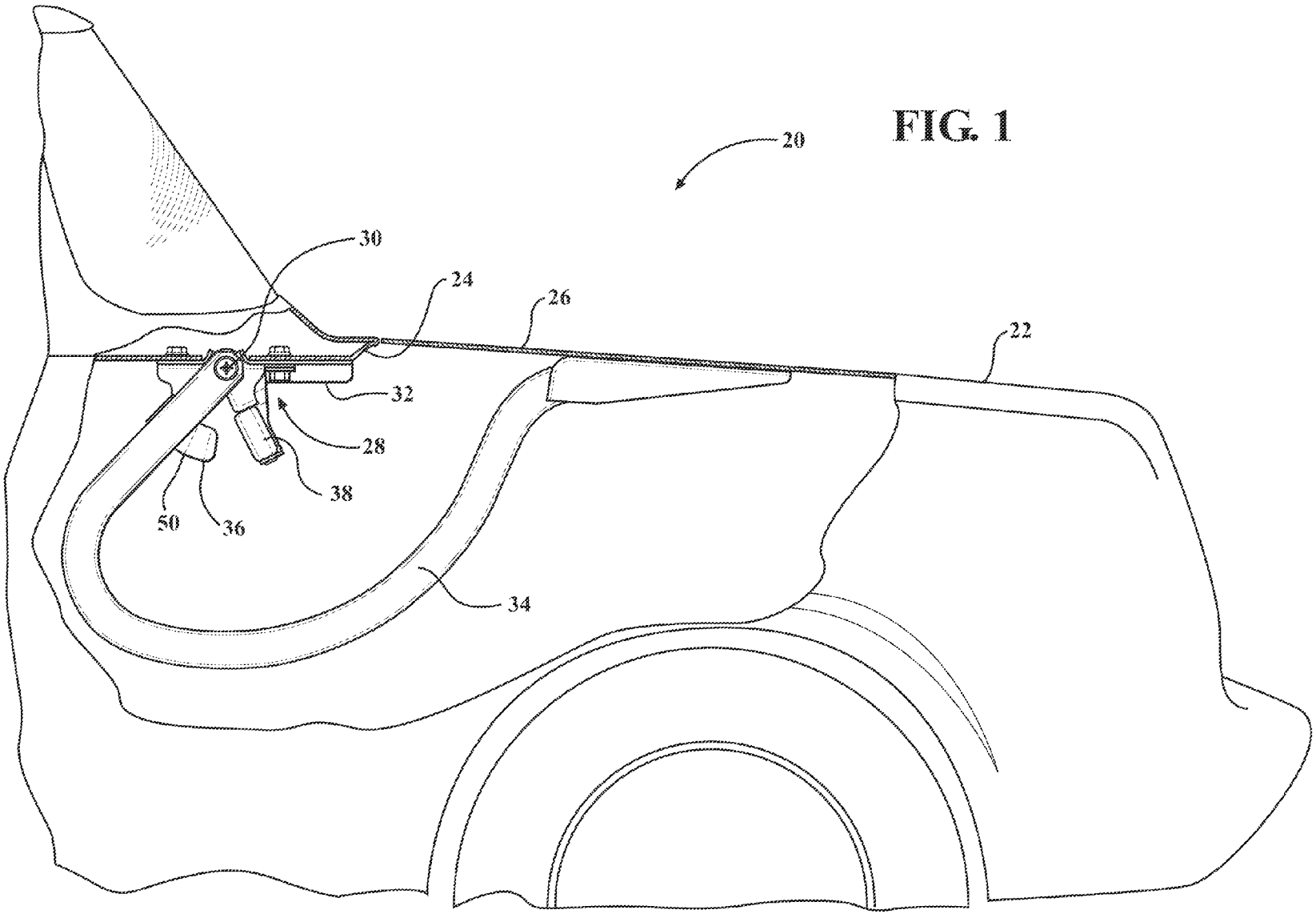
FIG. 1 is a schematic cross sectional view of a vehicle showing a hinge assembly rotatably connecting a decklid to a body of the vehicle.

Referring to the Figures, wherein like numerals indicate like parts throughout the several views, a vehicle is generally shown at 20. Referring to FIG. 1, the vehicle 20 includes a body 22 that defines an opening 24. The opening 24 may provide access, for example, to a trunk or other cargo area of the vehicle 20. A decklid 26 is configured for closing the opening 24, and is moveable between a closed position sealing the opening 24, and an open position allowing access to the cargo area through the opening 24. A hinge assembly 28 rotatably interconnects the decklid 26 and the body 22. The hinge assembly 28 rotatably supports the decklid 26 for rotation about a rotation axis 30 between the open position and the closed position.

The hinge assembly 28 includes a hinge box 32 that is configured for attachment to the body 22 of the vehicle 20. The hinge box 32 may be attached to the body 22 in any suitable manner. For example, the hinge box 32 may be attached to the body 22 with one or more fasteners, including but not limited to bolts, screws, etc. A decklid attachment bracket 34 is rotatably coupled to the hinge box 32. The decklid attachment bracket 34 is rotatable relative to the hinge box 32 about the rotation axis 30 for rotation between the closed position and the open position. The decklid 26 is secured to and moveable with the decklid attachment bracket 34. The decklid 26 may be attached to the decklid attachment bracket 34 in any suitable manner. The decklid attachment bracket 34 may be shaped and/or configured in any suitable manner, and may include but is not limited to a counterbalanced bracket designed to automatically move the decklid 26 from the closed position into the open position upon the decklid 26 being un-latched.

Figure 2:
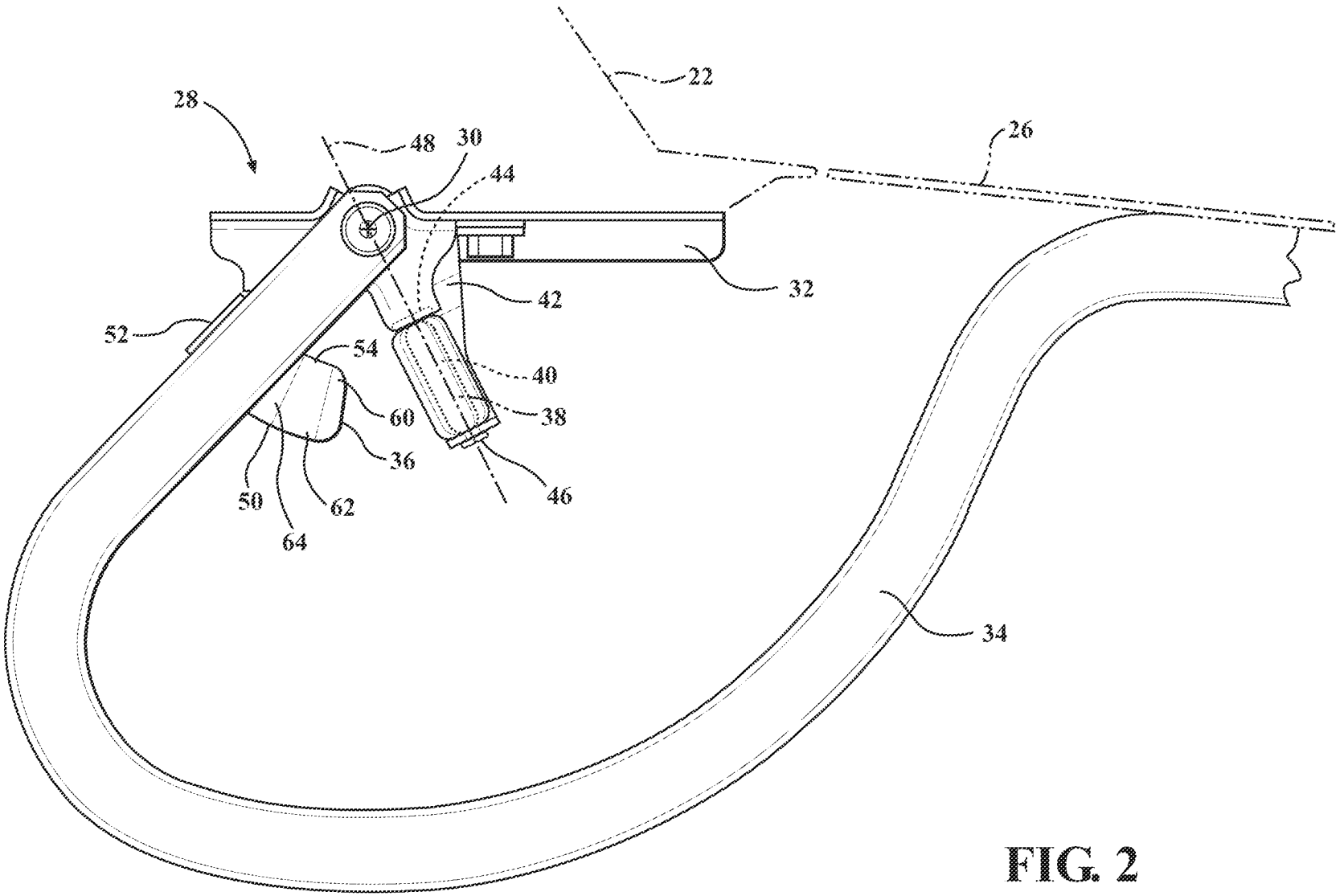
FIG. 2 is a schematic side view of the hinge assembly in a closed position.
Figure 3:
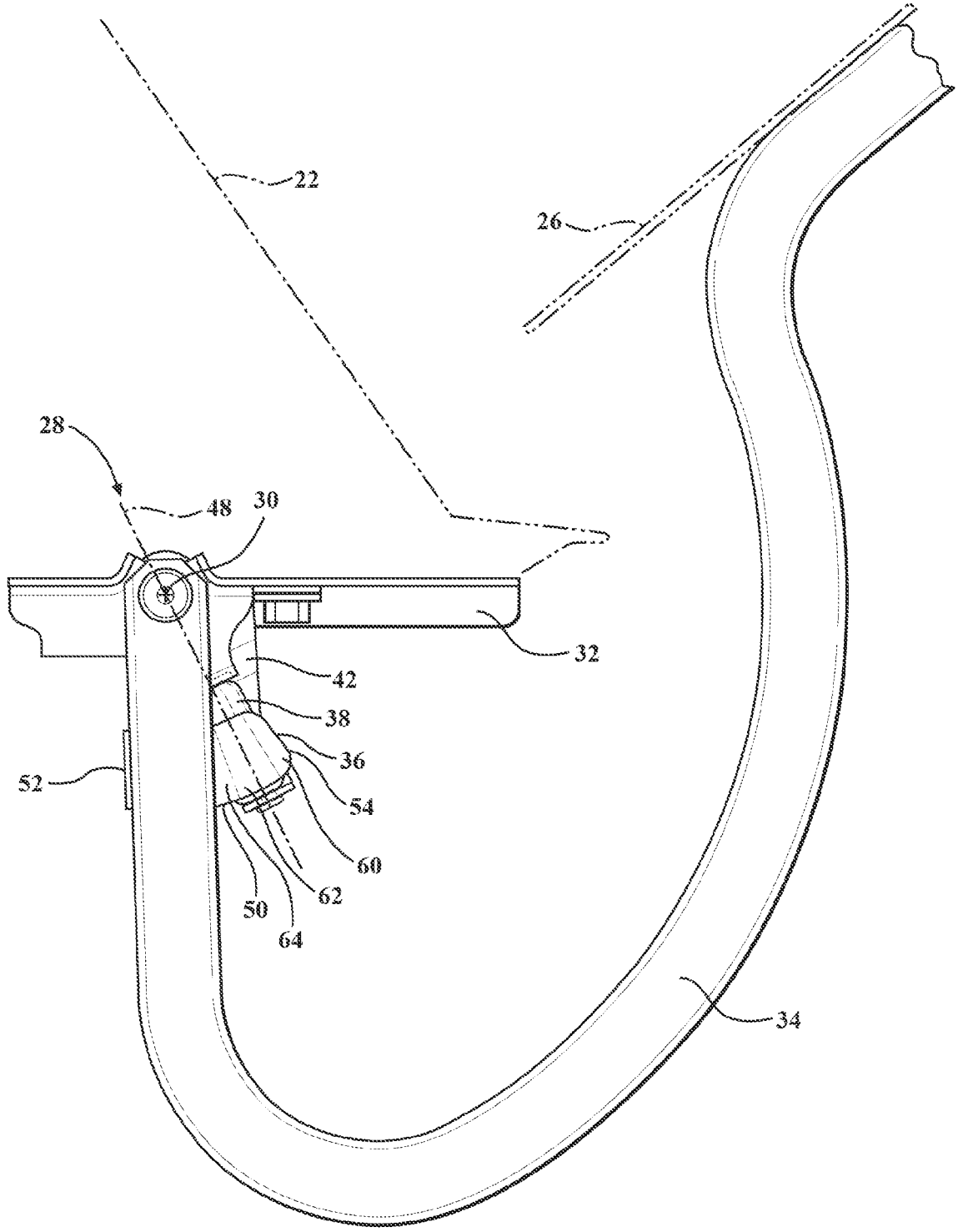
FIG. 3 is a schematic side view of the hinge assembly in an open position.
Figure 4:
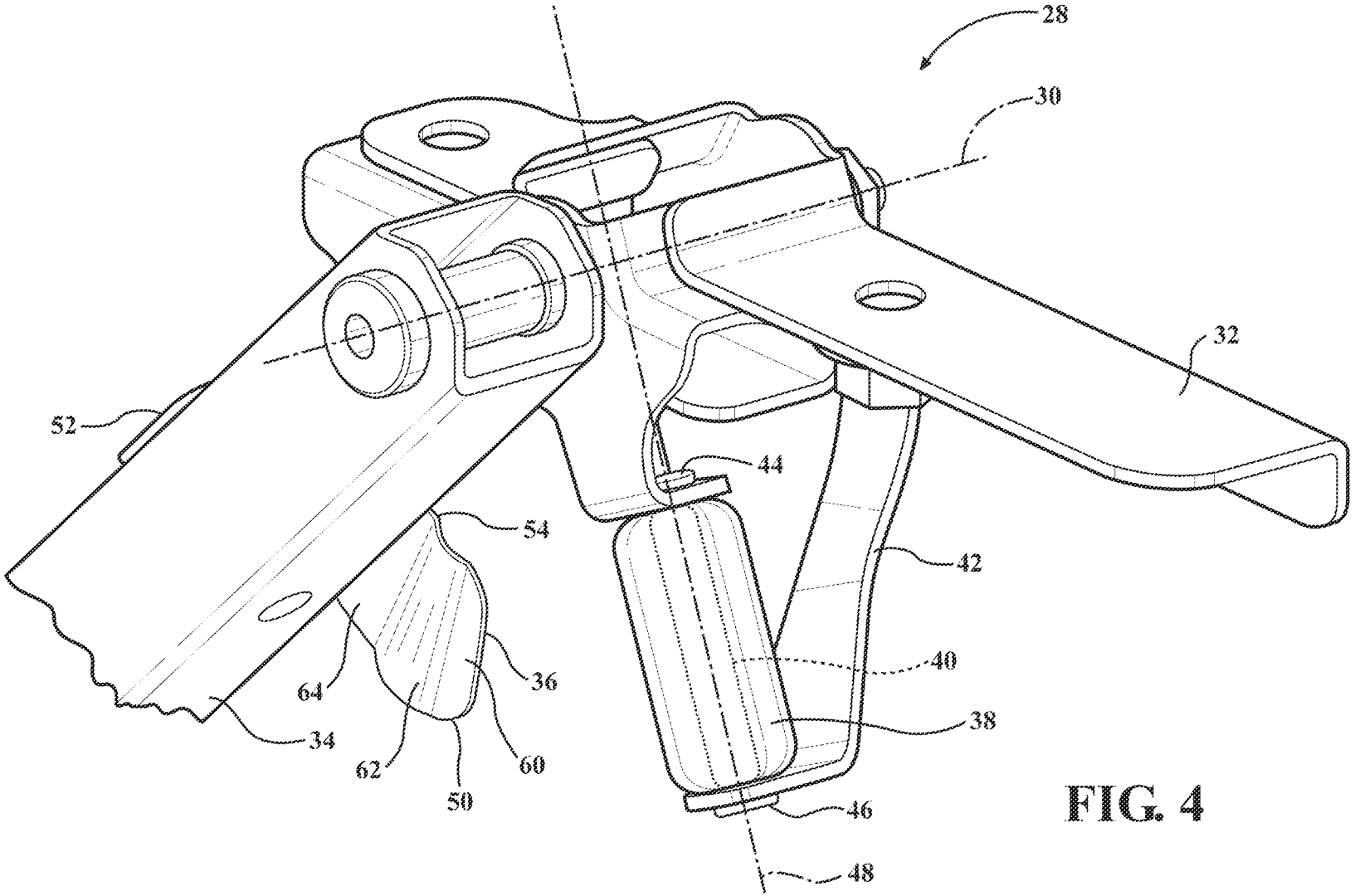
FIG. 4 is a schematic perspective view of the hinge assembly in the closed position.

Referring to FIGS. 2 through 4, the decklid attachment bracket 34 includes a contoured surface 36. A compressible member 38 is positioned relative to the decklid attachment bracket 34 for engagement with the contoured surface 36. The contoured surface 36 engages the compressible member 38 as the decklid attachment bracket 34 moves between the open position, shown in FIG. 3, and the closed position, shown in FIGS. 2 and 4.

The compressible member 38 may be attached to either the hinge box 32, or the body 22 of the vehicle 20. As shown, for example, the compressible member 38 is rotatably attached to the hinge box 32 via a roller pin 40, which is supported by a roller support bracket 42. The roller pin 40 includes a first end 44 that is directly attached to the hinge box 32. The roller pin 40 extends from the first end 44 to a distal end 46. The roller support bracket 42 interconnects the distal end 46 of the roller pin 40 and the hinge box 32. The roller pin 40 rotatably supports the compressible member 38. The roller pin 40 is concentrically disposed about and defines a roller axis 48. The roller axis 48 is disposed transversely relative to the rotation axis 30, i.e., the roller axis 48 is substantially perpendicular to and approximately intersects the rotation axis 30. The compressible member 38 includes a cylindrical shape having a longitudinal center that is disposed along the roller axis 48. The compressible member 38 is rotatable about the roller axis 48. The compressible member 38 is rotatable relative to the contoured surface 36 about the roller axis 48 to allow the compressible member 38 to roll over the contoured surface 36 as the contoured surface 36 moves past the compressible member 38. While the exemplary embodiment described herein includes the compressible member 38 being rotatable relative to the contoured surface 36, it should be appreciated that the compressible member 38 need not rotate relative to the contoured surface 36, and may alternatively slide over the contoured surface 36.

The compressible member 38 is compressible, and is configured with a durometer rating to meet the required deflection and force for suitable damping. The compressible member 38 may include and be formed from any compressible material having the required spring rate. For example, the compressible member 38 may include and be manufactured from a rubber material, or some other suitable material.

A deflection member 50 is attached to the decklid attachment bracket 34. The deflection member 50 defines the contoured surface 36. Although the exemplary embodiment shown in the Figures and described herein includes the contoured surface 36 being defined by the deflection member 50, it should be appreciated that the contoured surface 36 may alternatively be directly defined by a surface of the decklid attachment bracket 34.

Figure 5:
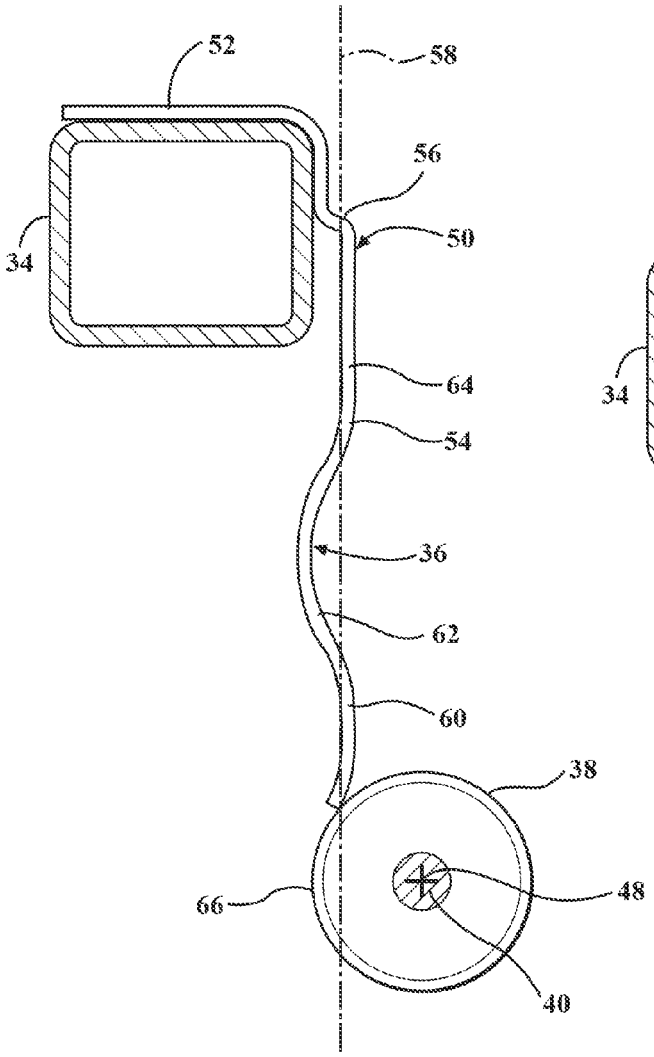
FIG. 5 is a schematic cross sectional view of a deflection member and a compressible member of the hinge assembly shown in the closed position.
Figure 6:
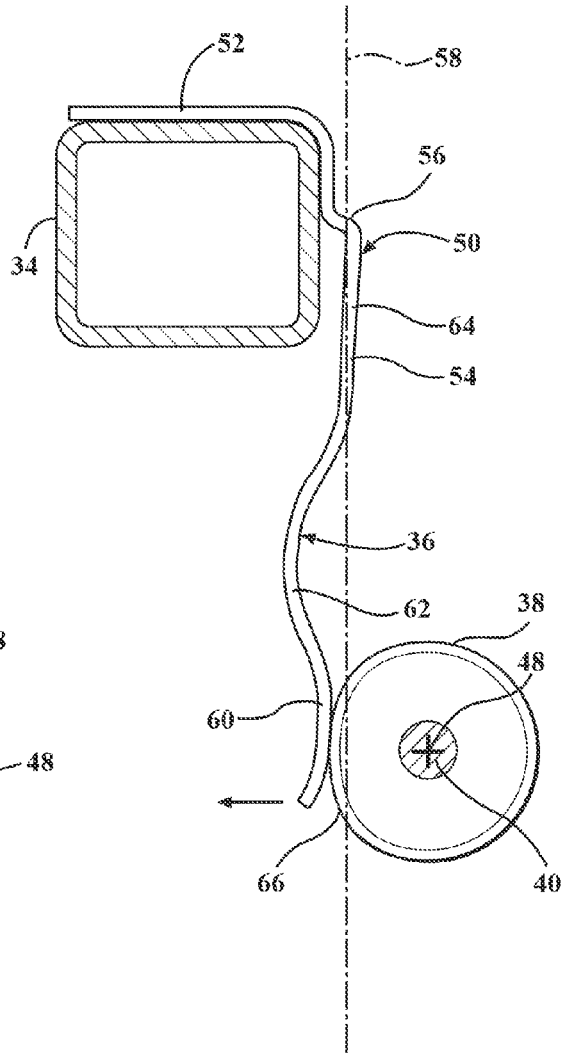
FIG. 6 is a schematic cross sectional view of the deflection member and the compressible member of the hinge assembly shown in the open position.

The deflection member 50 is preferably a stamped metal component. However, the deflection member 50 may include and be manufactured from some other material, and be formed by any suitable process. Referring to FIG. 5, the deflection member 50 includes a mounting portion 52 and a cantilevered portion 54. The mounting portion 52 is attached to the decklid attachment bracket 34. The mounting portion 52 may be shaped and or sized in any suitable manner for attachment to the decklid attachment bracket 34. Furthermore, the mounting portion 52 may be attached to the decklid attachment bracket 34 in any suitable manner, such as but not limited a mechanical connection using one or more fasteners, or a welded connection. The cantilevered portion 54 is spaced from the bracket and defines the contoured surface 36. Referring to FIG. 6, the cantilevered portion 54 is flexible relative to the decklid attachment bracket 34 and/or the compressible member 38 about an intersection 56 between the mounting portion 52 and the cantilevered portion 54. Accordingly, the deflection member 50 may be described as a spring, in which the cantilevered portion 54 both flexes and bends relative to the mounting portion 52. When moving between the open position and the closed position and prior to the deflection member 50 contacting the compressible member 38, the cantilevered portion 54 is disposed substantially along a plane 58 that is parallel with a direction of movement of the decklid attachment bracket 34. The plane 58 of the cantilevered portion 54 is also substantially parallel with the roller axis 48. Upon the deflection member 50 contacting the compressible member 38, the deflection member 50 flexes away from the compressible member 38, and away from the plane 58.

As best shown in FIGS. 2, 5 and 6, the contoured surface 36 defines an outer region 60, a recessed region 62, and an inner region 64. The recessed region 62 is disposed between the outer region 60 and the inner region 64. The inner region 64 and the outer region 60 are substantially disposed along the plane 58 of the cantilevered portion 54, with the recessed region 62 spaced from the plane 58. The recessed region 62 is formed to mate with a perimeter 66 of the compressible member 38. As noted above, the compressible member 38 includes a cylindrical shape. Accordingly, the recessed region 62 is formed to mate with the outer perimeter 66 of the cylindrical shape of the compressible member 38.

During movement of the decklid attachment bracket 34 from the closed position into the open position, the compressible member 38 engages the contoured surface 36. Specifically, when moving from the closed position into the open position, the compressible member 38 engages that outer region 60, shown in FIG. 6, and then engages the recessed region 62. The recessed region 62 secures the position of the decklid attachment bracket 34 in the open position, as shown in FIG. 3. If the decklid attachment bracket 34 moves beyond the open position, then the compressible member 38 engages the inner region 64 of the contoured surface 36.

When the compressible member 38 is engaged with the outer region 60 of the contoured surface 36, the outer region 60 is positioned relative to the compressible member 38 to compress the compressible member 38 as the decklid attachment bracket 34 moves into and out of the open position. Compressing the compressible member 38 absorbs energy and dampens movement of the decklid attachment bracket 34 relative to the hinge box 32, thereby slowing movement and reducing bobble of the decklid attachment bracket 34.

Upon the decklid attachment bracket 34 reaching the open position, the compressible member 38 engages the recessed region 62 of the contoured surface 36. When the decklid attachment bracket 34 is disposed in the open position, the recessed region 62 cradles the compressible member 38 without substantially compressing the compressible member 38. The recessed region 62 cradles the compressible member 38 in order to secure the compressible member 38 within the recessed region 62, and limit movement of the compressible member 38 out of the recessed region 62.

If the momentum of the decklid attachment bracket 34 carries the decklid attachment bracket 34 beyond the open position, then the compressible member 38 engages the inner region 64 of the contoured surface 36. The inner region 64 is positioned relative to the compressible member 38 to compress the compressible member 38 as the decklid attachment bracket 34 moves beyond the open position. The inner region 64 compresses the compressible member 38 to absorb energy and dampen movement of the decklid attachment bracket 34 relative to the hinge box 32, to limit movement of the decklid attachment bracket 34 beyond the open position.

As described above, when the decklid attachment bracket 34 is disposed in the open position, the compressible member 38 is cradled by the recessed region 62 of the contoured surface 36. In order for the decklid attachment bracket 34 to move relative to the compressible member 38, the compressible member 38 must engage either the outer region 60 or the inner region 64, which compresses the compressible member 38. As such, movement of the decklid attachment bracket 34 out of the open position, for example into the closed position, requires enough energy to compress the compressible member 38 and or flex the deflection member 50 as the compressible member 38 moves out of the recessed region 62 and over the outer region 60 of the contoured surface 36. Therefore, the interaction between the recessed region 62 and the compressible member 38 operates to retain the position of the decklid attachment bracket 34 in the open position. Similarly, movement of the decklid attachment bracket 34 beyond the open position requires the application of enough energy to compress the compressible member 38 and/or bend the deflection member 50 as the compressible member 38 moves out of the recessed region 62 and over the inner region 64.

As described above, the contoured surface 36 is disposed on the deflection member 50, which may deflect or spring away from the compressible member 38 and/or the decklid attachment bracket 34. When the compressible member 38 is engaged with either the outer region 60 or the inner region 64 of the contoured surface 36, the interaction between the compressible member 38 and the cantilevered portion 54 of the deflection member 50 causes the cantilevered portion 54 to flex or spring away from the compressible member 38. The cantilevered portion 54 flexes and/or springs away from the compressible member 38 to absorb energy and dampen movement of the decklid attachment bracket 34 relative to the hinge box 32, as the compressible member 38 rolls over either the outer region 60 or the inner region 64 of the contoured surface 36.

The amount of energy absorbed by the hinge assembly 28 is dependent upon a spring constant of the deflection member 50, and the compressibility of the compressible member 38. Increasing the stiffness of the deflection member 50 increases the amount of energy absorbed by the deflection member 50 when the cantilevered portion 54 is flexed inward to allow the compressible member 38 to roll over. Similarly, increasing the durometer of the compressible member 38 increases the amount of energy absorbed by the compressible member 38 when the compressible member 38 engages either the inner region 64 or the outer region 60 of the contoured surface 36. In contrast, decreasing the stiffness of the deflection member 50 decreases the amount of energy absorbed by the deflection member 50 when the cantilevered portion 54 is flexed inward to allow the compressible member 38 to roll over. Similarly, decreasing the durometer of the compressible member 38 decreases the amount of energy absorbed by the compressible member 38 when the compressible member 38 engages either the inner region 64 or the outer region 60 of the contoured surface 36. The required damping is achieved by both the compression of the compressible member 38, and the deflection of the deflection member 50. The stiffness of the compressible member 38 and the deflection member 50 is interactive, and a function of the shape of the recessed region 62, and the amount of energy inputted into the hinge assembly 28. As such, the durometer of the compressible member 38 and the stiffness of the deflection member 50 must be determined for each specific application to accommodate the different amount of kinetic energy input into the hinge assembly 28, including but not limited to the weight of the decklid 26, a spring stiffness of a counterbalanced spring system (not shown), potential wind load on the decklid 26, etc.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A hinge assembly for a trunk decklid of a vehicle, the hinge assembly comprising:

a hinge box;

a decklid attachment bracket including a contoured surface, the decklid attachment bracket being rotatably attached to the hinge box for rotation about a rotation axis between an open position and a closed position; and a compressible member configured for attachment to one of a body of the vehicle and the hinge box, and positioned relative to the decklid attachment bracket for engagement with the contoured surface as the decklid attachment bracket moves between the open position and the closed position;

wherein the contoured surface defines an outer region, a recessed region, and an inner region;

wherein the outer region is operable to compress the compressible member as the decklid attachment bracket moves into and out of the open position to absorb energy and dampen movement of the decklid attachment bracket relative to the hinge box;

wherein the recessed region is operable to cradle the compressible member without substantially compressing the compressible member when the decklid attachment bracket is disposed in the open position; and wherein the inner region is operable to compress the compressible member to absorb energy and dampen movement of the decklid attachment bracket relative to the hinge box, to limit movement of the decklid attachment bracket beyond the open position.

2. A hinge assembly as set forth in claim 1 wherein the recessed region is disposed between the outer region and the inner region.

3. A hinge assembly as set forth in claim 2 wherein the inner region and the outer region are substantially disposed along a common plane, with the recessed region spaced from the common plane.

4. A hinge assembly as set forth in claim 3 wherein the recessed region is formed to mate with a perimeter of the compressible member.

5. A hinge assembly as set forth in claim 1 wherein the compressible member is rotatable relative to the contoured surface about a roller axis to allow the compressible member to roll over the contoured surface as the contoured surface moves past the compressible member, wherein the roller axis is disposed transversely relative to the rotation axis.

6. A hinge assembly as set forth in claim 5 wherein the compressible member is rotatably attached to the hinge box.

7. A hinge assembly as set forth in claim 6 further comprising a roller pin attached to the hinge box and concentrically disposed about the roller axis, wherein the roller pin rotatably supports the compressible member.

8. A hinge assembly as set forth in claim 7 further comprising a roller support bracket interconnecting a distal end of the roller pin and the hinge box.

9. A hinge assembly as set forth in claim 5 wherein the compressible member includes a cylindrical shape having a longitudinal center disposed along the roller axis.

10. A hinge assembly as set forth in claim 1 wherein the compressible member includes and is manufactured from a rubber material.

11. A hinge assembly as set forth in claim 1 further comprising a deflection member attached to the decklid attachment bracket and defining the contoured surface.

12. A hinge assembly as set forth in claim 11 wherein the deflection member is operable to deflect away from the compressible member when the compressible member is engaged with either the outer region or the inner region of the contoured surface to absorb energy and dampen movement of the decklid attachment bracket relative to the hinge box.

13. A hinge assembly as set forth in claim 12 wherein the deflection member includes a mounting portion attached to the decklid attachment bracket, and a cantilevered portion spaced from the bracket and defining the contoured surface, and wherein the cantilevered portion of the deflection member is flexible relative to the decklid attachment bracket about an intersection between the mounting portion and the cantilevered portion.

14. A hinge assembly as set forth in claim 13 wherein the cantilevered portion is disposed substantially parallel with a direction of movement of the decklid attachment bracket when moving between the open position and the closed position.

15. A vehicle comprising:

a body defining an opening; and a hinge assembly rotatably interconnecting a decklid to the body for rotation about a rotation axis between an open position and a closed position, wherein the hinge assembly includes:

a hinge box;

a decklid attachment bracket rotatably attached to the hinge box for rotation about the rotation axis between the open position and the closed position, and including a deflection member moveable with the decklid attachment bracket and defining a contoured surface; and a compressible member attached to one of the body and the hinge box, and positioned relative to the deflection member for engagement with the contoured surface as the deflection member moves between the open position and the closed position;

wherein the contoured surface defines an outer region, a recessed region, and an inner region;

wherein the outer region is operable to compress the compressible member as the decklid attachment bracket moves into and out of the open position to absorb energy and dampen movement of the decklid attachment bracket relative to the hinge box;

wherein the recessed region is operable to cradle the compressible member without substantially compressing the compressible member when the decklid attachment bracket is disposed in the open position;

wherein the inner region is operable to compress the compressible member to absorb energy and dampen movement of the decklid attachment bracket relative to the hinge box, to limit movement of the decklid attachment bracket beyond the open position; and wherein the deflection member is operable to deflect away from the compressible member when the compressible member is engaged with either of the outer region or the inner region of the contoured surface to absorb energy and dampen movement of the decklid attachment bracket relative to the hinge box.

16. A vehicle as set forth in claim 15 wherein the recessed region is disposed between the outer region and the inner region, wherein the inner region and the outer region are substantially disposed along a common plane, with the recessed region spaced from the common plane, and wherein the recessed region is formed to mate with a perimeter of the compressible member.

17. A vehicle as set forth in claim 16 wherein the compressible member includes a cylindrical shape having a longitudinal center disposed along a roller axis, and is rotatable relative to the contoured surface about the roller axis to allow the compressible member to roll over the contoured surface as the contoured surface moves past the compressible member, and wherein the roller axis is disposed transversely relative to the rotation axis.

18. A vehicle as set forth in claim 17 wherein the deflection member includes a mounting portion attached to the decklid attachment bracket, and a cantilevered portion spaced from the bracket and defining the contoured surface, wherein the cantilevered portion of the deflection member is flexible relative to the decklid attachment bracket about an intersection between the mounting portion and the cantilevered portion, and wherein the cantilevered portion is disposed substantially parallel with a direction of movement of the decklid attachment bracket when moving between the open position and the closed position.

* * * * *